US007901271B2

(12) United States Patent
Buta

(10) Patent No.: US 7,901,271 B2
(45) Date of Patent: Mar. 8, 2011

(54) SHIMLESS DUAL ARBOR SCRAP CHOPPER

(76) Inventor: John R. Buta, Salem, OH (US)

( * ) Notice: Subject to any disclaimer, the term of this patent is extended or adjusted under 35 U.S.C. 154(b) by 0 days.

(21) Appl. No.: 12/545,952

(22) Filed: Aug. 24, 2009

(65) Prior Publication Data

US 2010/0071185 A1 Mar. 25, 2010

Related U.S. Application Data

(62) Division of application No. 11/163,610, filed on Oct. 25, 2005, now abandoned.

(60) Provisional application No. 60/621,860, filed on Oct. 25, 2004.

(51) Int. Cl.
*B24B 3/36* (2006.01)

(52) U.S. Cl. ..... 451/48; 451/28

(58) Field of Classification Search ..... 451/28, 451/48, 185; 29/402.06
See application file for complete search history.

(56) References Cited

U.S. PATENT DOCUMENTS

| | | | | |
|---|---|---|---|---|
| 3,110,209 | A * | 11/1963 | Takehara | 83/322 |
| 4,004,479 | A | 1/1977 | Bodnar | |
| 4,630,514 | A | 12/1986 | Ohmori et al. | |
| 4,858,506 | A | 8/1989 | Buta | |
| 5,720,210 | A | 2/1998 | Okahashi | |
| 6,155,151 | A | 12/2000 | Reichert | |
| 6,742,427 | B2 | 6/2004 | Buta | |
| 2003/0121381 | A1 | 7/2003 | Buta | |

* cited by examiner

*Primary Examiner* — Robert Rose
(74) *Attorney, Agent, or Firm* — Fay Sharpe LLP

(57) ABSTRACT

A dual arbor chopper that is configured such that the knife blades of the chopper do not require shims after being sharpened. The arbors utilize a blade attachment recess that is oriented in an opposite direction as existing arbors used in choppers, in combination with a clamping block to provide support against the cutting force against the blade. An attachment fastener is provided to attach the clamping block and the knife blade to the arbor through an aperture provided in the clamping block and the knife blade. The cutting edge is positioned in the same location in the new and sharpened condition, thus eliminating the need for shims.

7 Claims, 9 Drawing Sheets

SHIMLESS DUAL ARBOR SCRAP CHOPPER

This application claims the benefit of U.S. Provisional Patent Application Ser. No. 60/621,860, filed Oct. 25, 2004, herein incorporated by reference. This application is a divisional of U.S. application Ser. No. 11/163,610, filed Oct. 25, 2005 now abandoned, the disclosure of which is hereby incorporated by reference.

TECHNICAL FIELD

This invention relates to choppers that are used in scrap edge trimming of flat sheet metal or other scrap strip production processes that require effective collection and removal of large quantities of scrap strip material, more specifically the invention relates to a dual arbor chopper that does not require shims after the chopper knife blades are sharpened.

BACKGROUND OF THE INVENTION

During processing of sheet materials such as sheet metal, it is frequently necessary to subdivide rolls or pieces of sheet stock into narrower rolls or pieces. A slitter apparatus is typically employed for this purpose, with the apparatus including a plurality of cutting mechanisms which cut the sheet stock lengthwise to the desired narrower widths. An edge trimmer apparatus is typically employed on each side of the slitter to cut off the bad edges.

Attendant to slitting or edge trimming of sheet material in this fashion, it is common for opposite edge portions of the sheet stock to be cut, and recycled as scrap material. Because such pieces of scrap material have lengths corresponding to that of the original sheet stock, it is desirable to continuously cut the scrap edge portions as the slitter or trimmer apparatus is operated to slit the sheet stock.

Typical dual arbor scrap choppers utilize knives that are three-dimensional helical knives when mounted on the drum. Another type of knife blade used in dual arbor scrap choppers is a two-dimensional cutting knife blade that is made at least partially in the form of a radius and/or at least partially in the form of an ellipse. Such a knife blade and associated arbor is disclosed in co-owned U.S. Pat. No. 4,858,506, incorporated herein by reference.

Knife blades used in chopping scrap become dull with use and need to be sharpened. The knife blades are sharpened by removing material from at least one side of the knife blade adjacent the cutting edge. When the material is removed, a shim is required between the arbor and the knife blade to compensate for the loss of material and to ensure that the cutting edge remains in the proper location with respect to the arbor and to the opposite cutting edge of the knife blade mounted on the opposing arbor. The installation of the shims can be time consuming as the correct shim width must be determined and installed. These prior art systems will be discussed in greater detail below.

It would therefore be an advantage to provide a dual arbor chopper that utilized a knife in a manner that did not require shims throughout the life of the knife.

SUMMARY OF THE INVENTION

The present invention overcomes at least one disadvantage of the prior art by providing a dual arbor chopper comprising: a support housing; a pair of oppositely disposed arbors rotatably positioned within the housing, each arbor having at least one blade attachment recess, the blade attachment recess including a first planar register surface oblique to a longitudinal axis of the arbor; at least one blade on each arbor positioned in a corresponding blade attachment recess, each blade including an active cutting edge; and a clamping block adapted to secure each blade in position within the corresponding blade attachment recess, wherein the clamping block is moveable toward and away from the first planar register surface to compensate for different blade widths; wherein the rotation of the arbors causes corresponding active cutting edges to progressively shear a material fed between the arbors.

At least one embodiment of the present invention provides a dual arbor chopper comprising: a support housing; a pair of oppositely disposed arbors rotatably positioned within the housing, each arbor having at least one blade attachment recess, the blade attachment recess formed having a first planar register surface oblique to a longitudinal axis of the arbor and a second register surface generally perpendicular to the first planar register surface; a drive means interconnecting and controlling relative rotational speed of the arbors; at least one blade on each arbor, each blade comprising a first face side generally parallel to a second face side, a first end opposite a second end, and a top surface opposite a bottom surface, wherein an active cutting edge is formed at the intersection of the top surface and the first face side; wherein each blade is positioned in a corresponding blade attachment recess such that the first face side registers against the first planar register surface of the arbor and the bottom surface of the blade registers against the second register surface of the arbor; and a clamping block registerable against the second face side of the blade; a fastener positioned through an aperture in the clamping block and the blade to attach the blade and the clamping block to the arbor; wherein the rotation of the arbors causes corresponding active cutting edges to progressively shear a material fed between the arbors.

Another embodiment of the present invention provides a method of sharpening a plurality of blades of a dual arbor chopper comprising the steps of: providing a dual arbor chopper comprising a support housing, a pair of oppositely disposed arbors rotatably positioned within the housing, each arbor having at least one blade attached to the arbor by a clamping block in a first position and at least one fastener, each blade comprising a first face side generally parallel to a second face side, and a top surface opposite a bottom surface, wherein an active cutting edge is formed at the intersection of the top surface and the first face side, wherein the first face side of the blade registers against the arbor and the clamping block registers against the second face side of the blade; removing the fastener and the clamping block from each arbor to release the blade when the active cutting edge of the blade is worn; sharpening each blade by grinding at least the first face side of the blade; attaching the blade to the arbor with a fastener and the clamping block such that the clamping block is positioned in a second position displaced from the first position by an amount equal to the material ground from the blade.

These and other advantages will be apparent upon a review of the drawings and detailed description of the invention.

BRIEF DESCRIPTION OF THE DRAWINGS

The invention will now be described in further detail with reference to the accompanying drawings, in which.

DETAILED DESCRIPTION OF THE DRAWINGS

Figure 1:
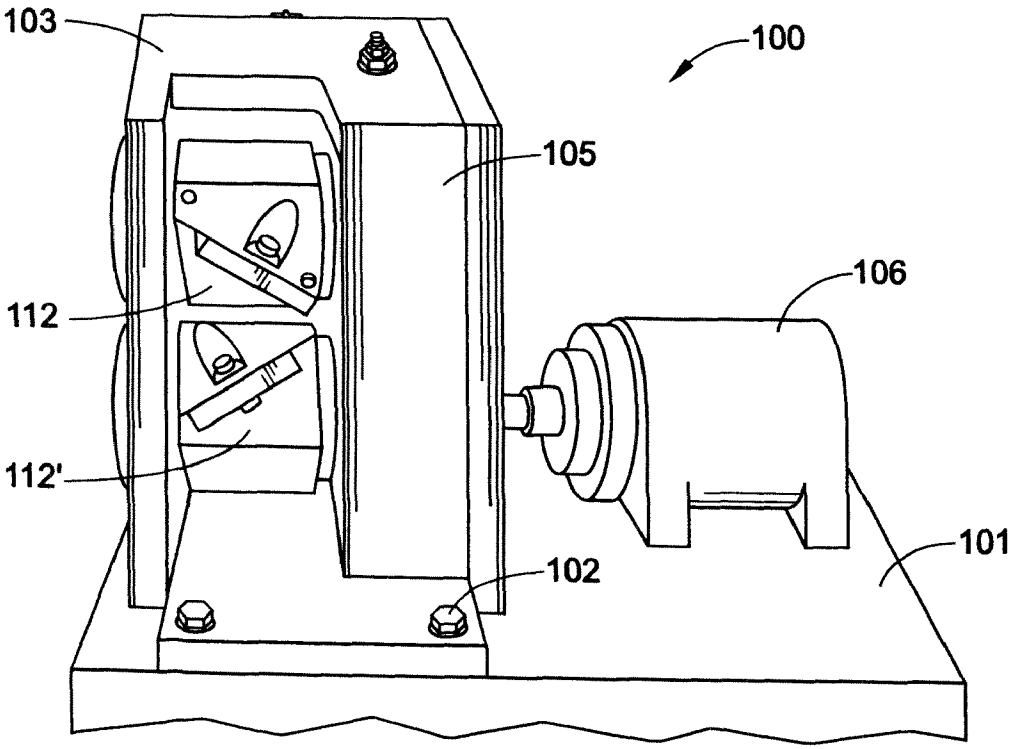
FIG. 1 is a perspective view of a prior art dual arbor scrap chopper with associated drive unit.

A prior art dual arbor scrap chopper 100 can be seen in FIG. 1 of the drawings comprising a mounting enclosure 105 securing to a base 101 by a plurality of fasteners 102. The mounting enclosure 105 has an opening at 103 in which is positioned a pair of rotating arbors 112 and 112' with associated support bearings and inner-connected speed regulator gearing reduction mechanism connected to a motor 106 as will be well understood and known in the art.

Figure 2:
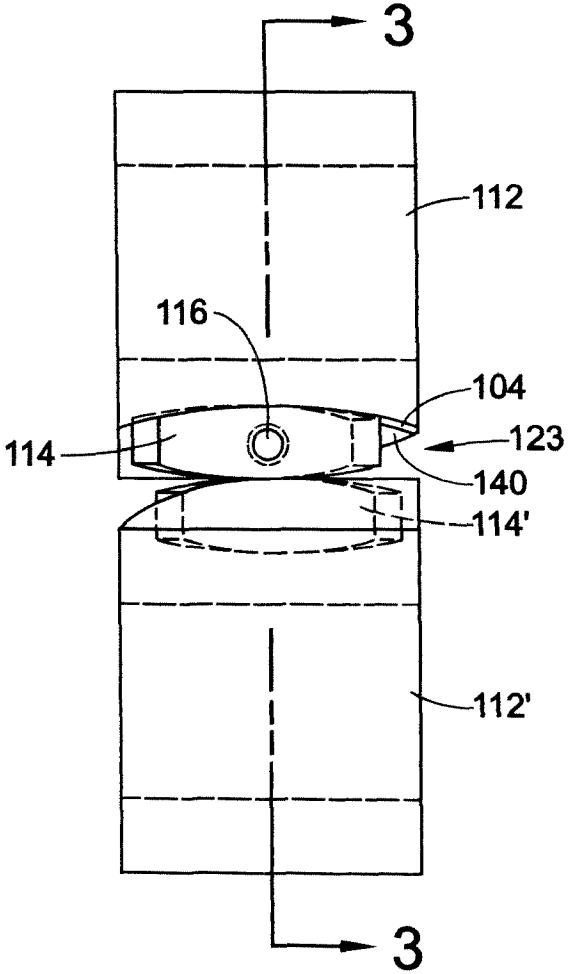
FIG. 2 is front elevational view of the arbors of FIG. 1 with two-dimensional knife blades positioned in the middle of a cut.
Figure 3:
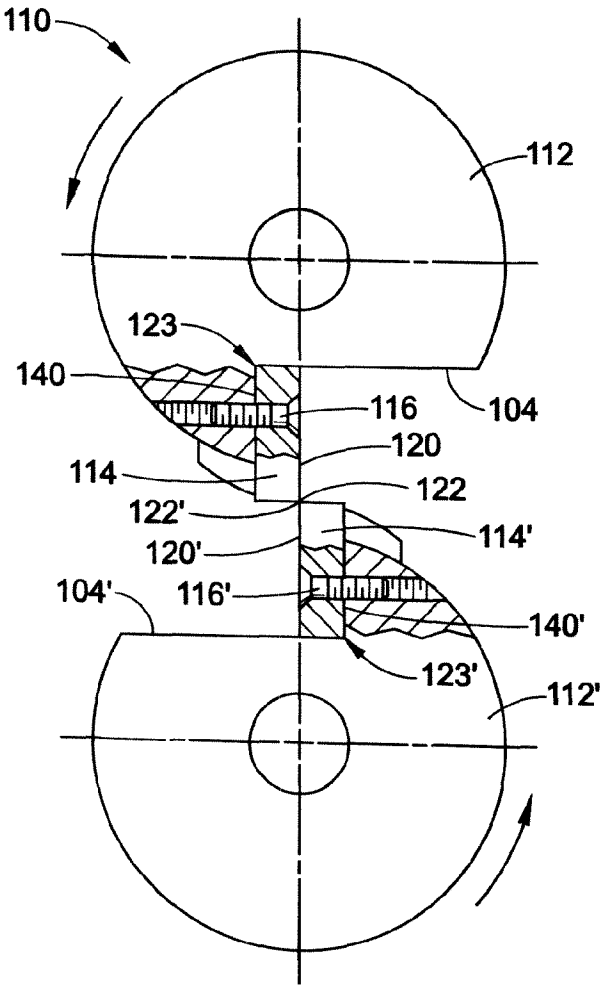
FIG. 3 is a cross-sectional view of the arbors of FIG. 2 showing the dual arbor two-dimensional knife blade.

A front elevational view of the arbors 112 and 112' of the prior art chopper of FIG. 1 is shown in FIG. 2 and a cross-sectional view of arbors 112 and 112' is shown in FIG. 3. Referring to FIGS. 2 and 3, arbors 112 and 112' are shown with each arbor 112, 112' utilizing a two-dimensional knife blade 114, 114' attached to the arbor 112, 112'. The knife blade 114, 114' is positioned in a blade seat 123, 123' formed in each arbor 112, 112'. The blade seats 123, 123' comprise a pair of oppositely disposed angularly aligned transverse recesses 104, 104' which extend to an angular upstanding edge mount 140, 140'. The transverse recesses 104, 104' are concave transversely perpendicular with the upstanding edge mount 140, 140'. A fastener 116, 116' is positioned through each knife blade 114, 114' to attach the knife blade 114, 114' to the arbor 112, 112'. The knife blade 114 has a cutting face side 120 having a cutting edge 122 which cooperates with the cutting edge 122' of the knife blade 114' of the opposite arbor 112'.

Figure 4A:
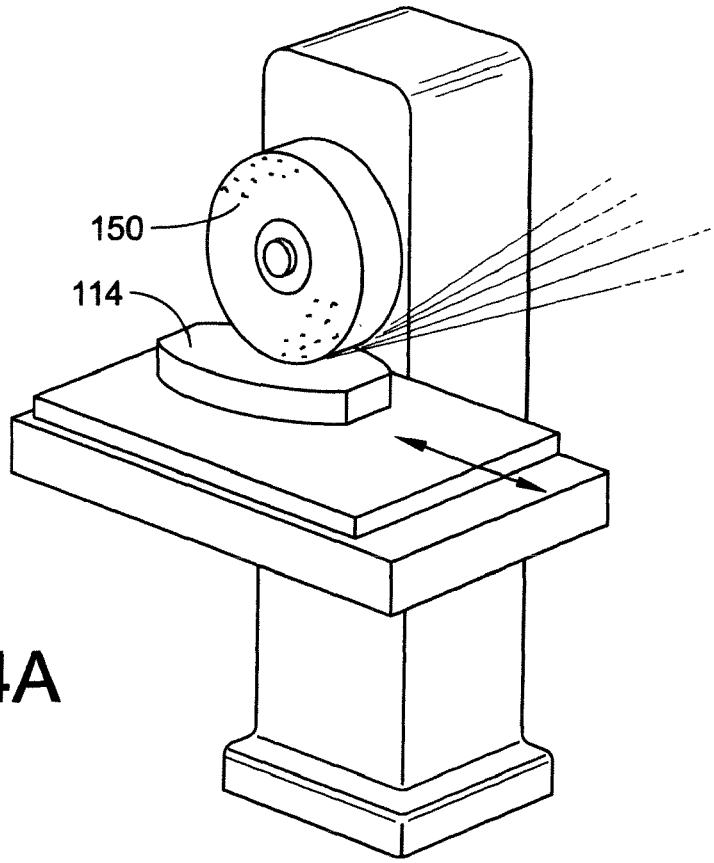
FIG. 4A is perspective view of a standard technique used to sharpen a two-dimensional knife blade and FIG. 4B is a side elevational view of the knife blade showing the removed material due to sharpening.
Figure 4B:
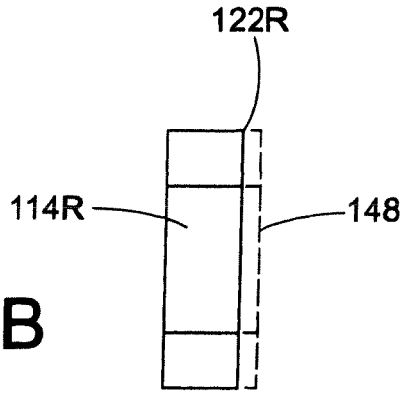
Figure 11:
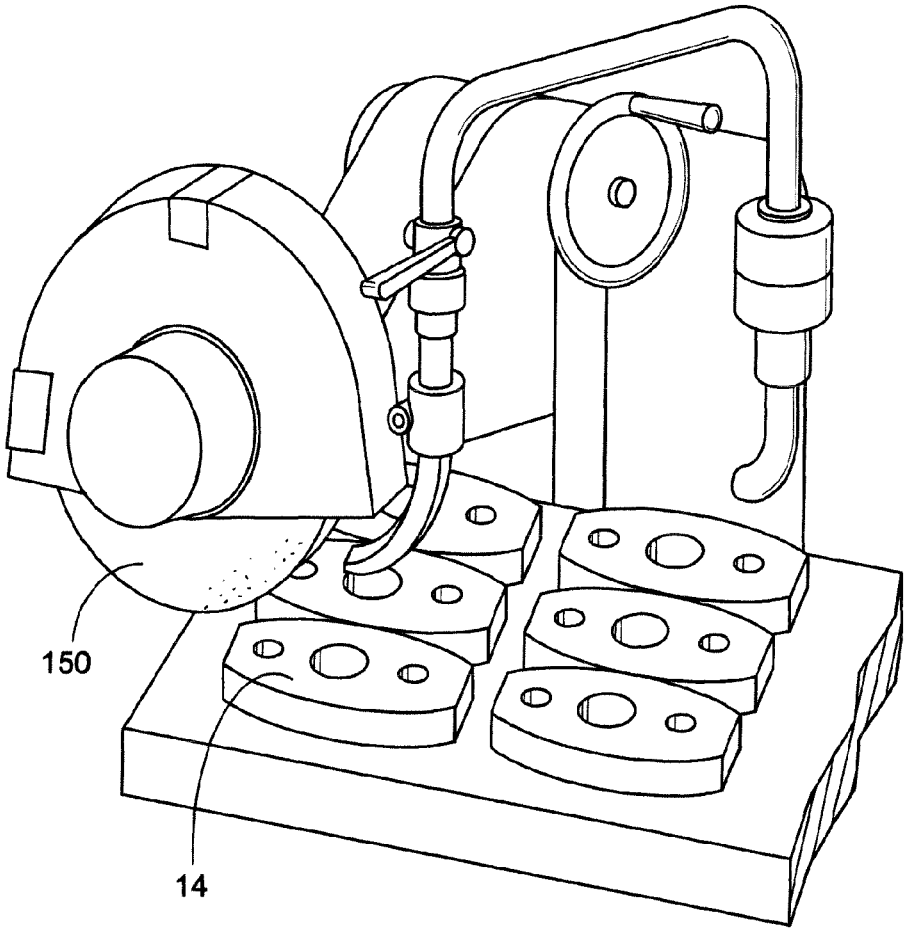
FIG. 11 is a perspective view of a face grinding sharpening of multiple two-dimensional knife blades.

After use, the cutting edges 122, 122' become dull and need to be resharpened. The knife blades 114, 114' are sharpened by removing a portion 148 (shown in phantom in FIG. 4B) of the face side 120 with a grinding wheel 150 as shown in FIG. 4A and 4B to create a sharpened knife blade 114R having a new cutting edge 122R. The face grind sharpening process of knife blades 114 is also shown in FIG. 11. It is noted that the cross-section of the knife blade 114 is generally rectangular such that the sharpening of knife blade 114 does not change the height of the cutting edge 122 when mounted in the arbor 112.

Figure 5:
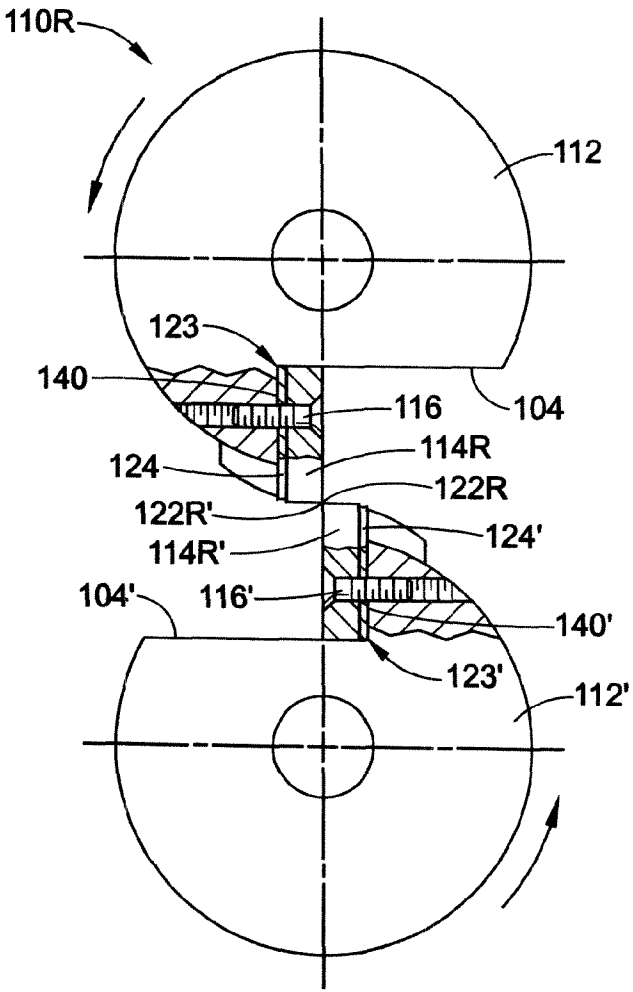
FIG. 5 is a cross-sectional view of the prior art arbors of FIG. 2 utilizing two-dimensional knife blades after sharpening and requiring a shim.
Figure 12:
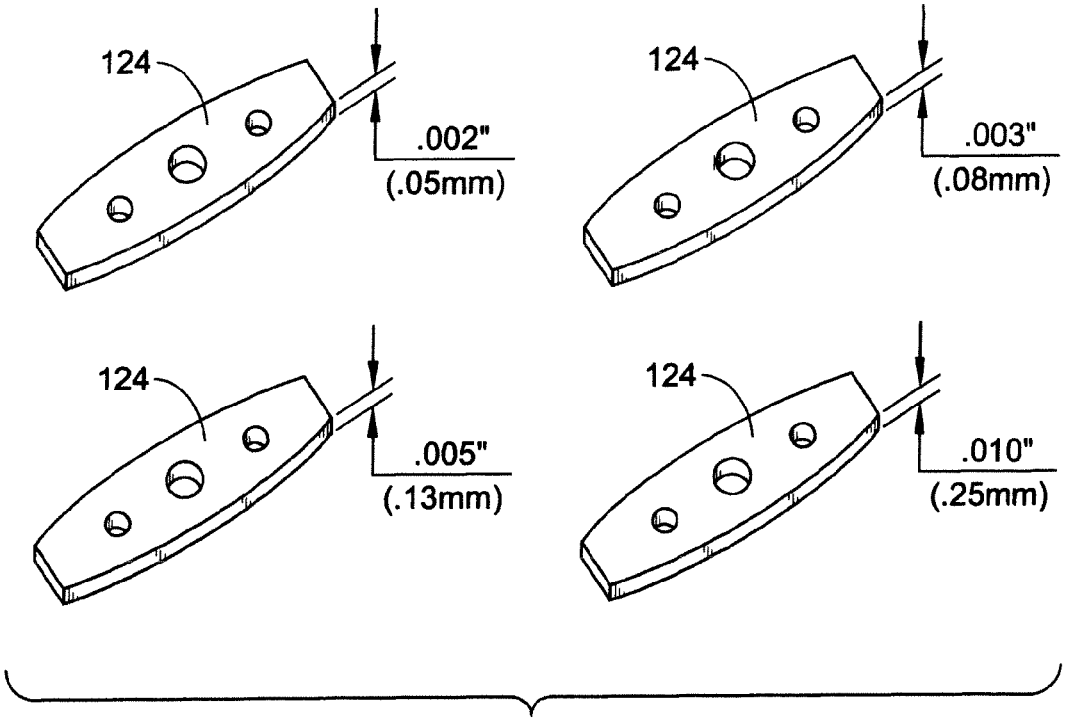
FIG. 12 is a perspective view of associated face shims as used in the prior art.

Referring now to the dual arbor chopper 110R shown in FIG. 5, the resharpened knife blades 114R, 114R' are remounted on arbors 112, 112' with a shim 124, 124' used to replace the removed material such that the resharpened cutting edges 122R, 122R' are re-positioned in the same location as when the knife blade 114, 114' was in the new condition. A variety of shims 124 are also shown in FIG. 12.

Figure 6:
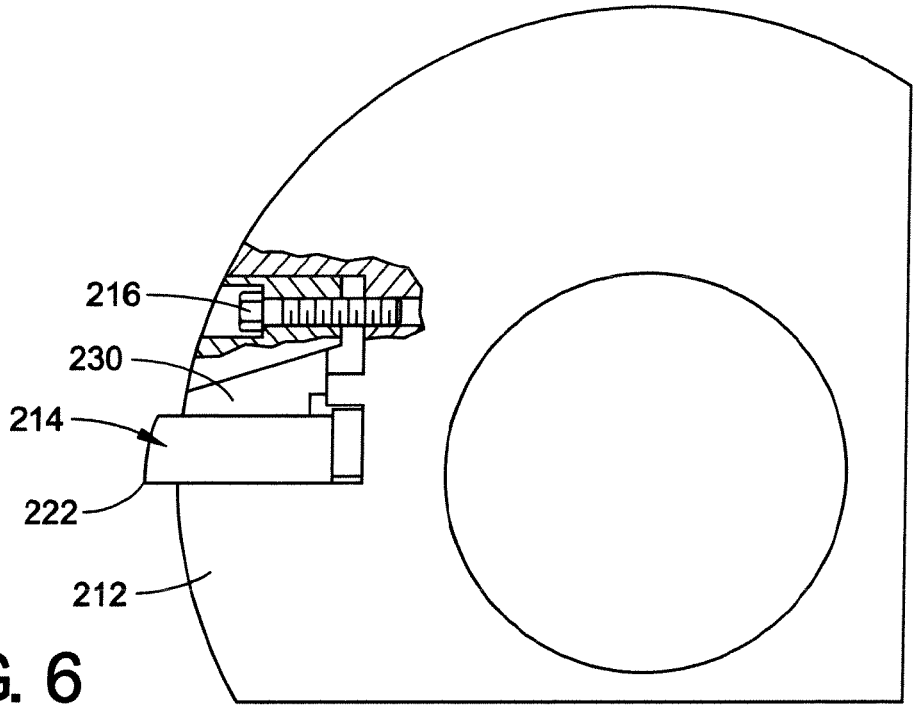
FIG. 6 is a cross-sectional view of a single prior art arbor of a dual arbor chopper utilizing a helical three-dimensional knife blade.
Figure 8:
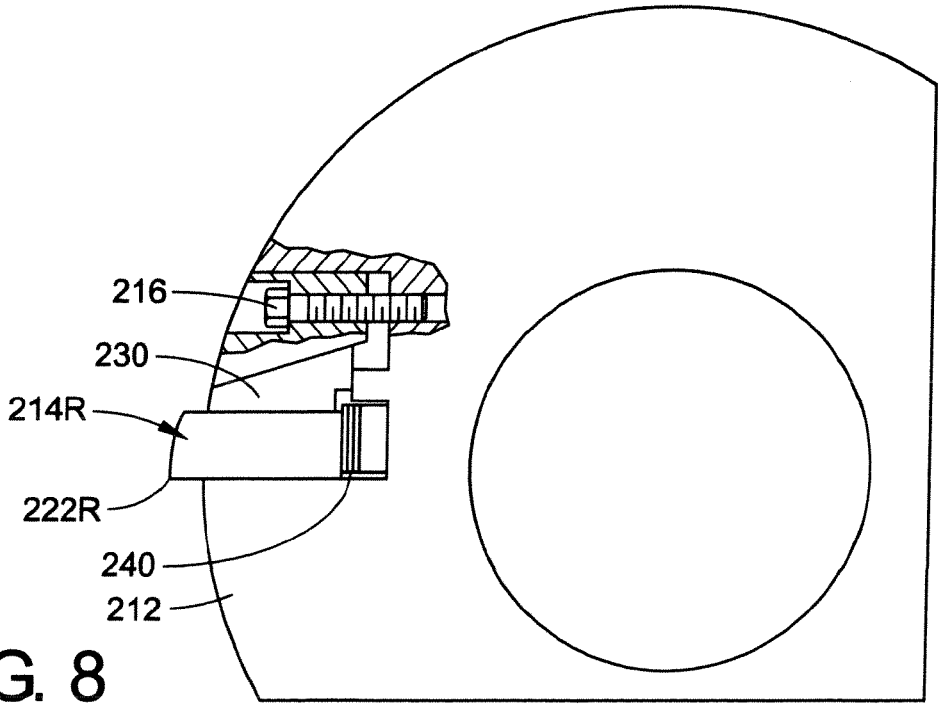
FIG. 8 is a cross-sectional view of the single prior art arbor of FIG. 6 utilizing a helical three-dimensional knife blade after sharpening and requiring a shim.
Figure 7A:
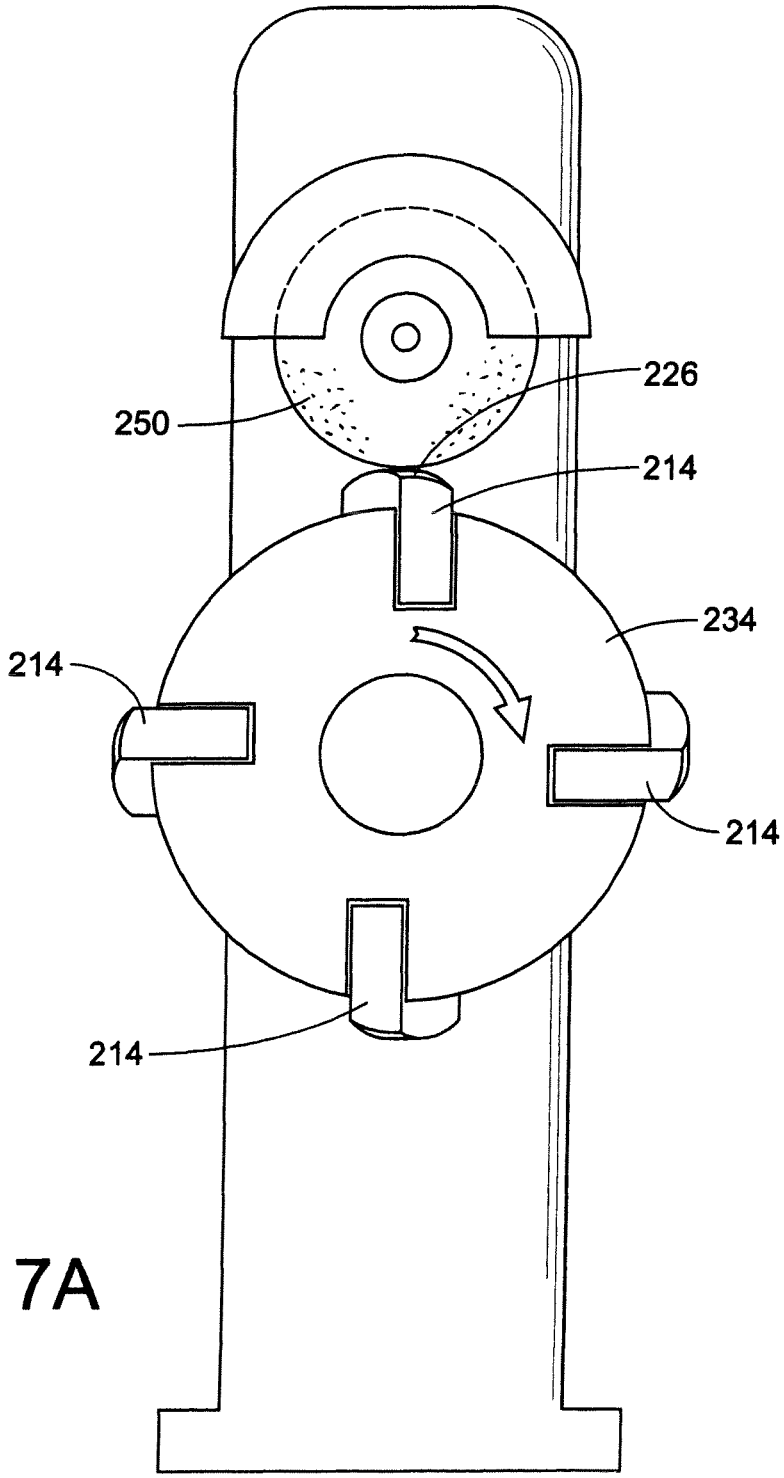
FIG. 7A is side elevational view of a standard technique used to sharpen a three-dimensional knife blade and FIG. 7B is a perspective and standard elevational views of a typical the helical knife blade.
Figure 7B:
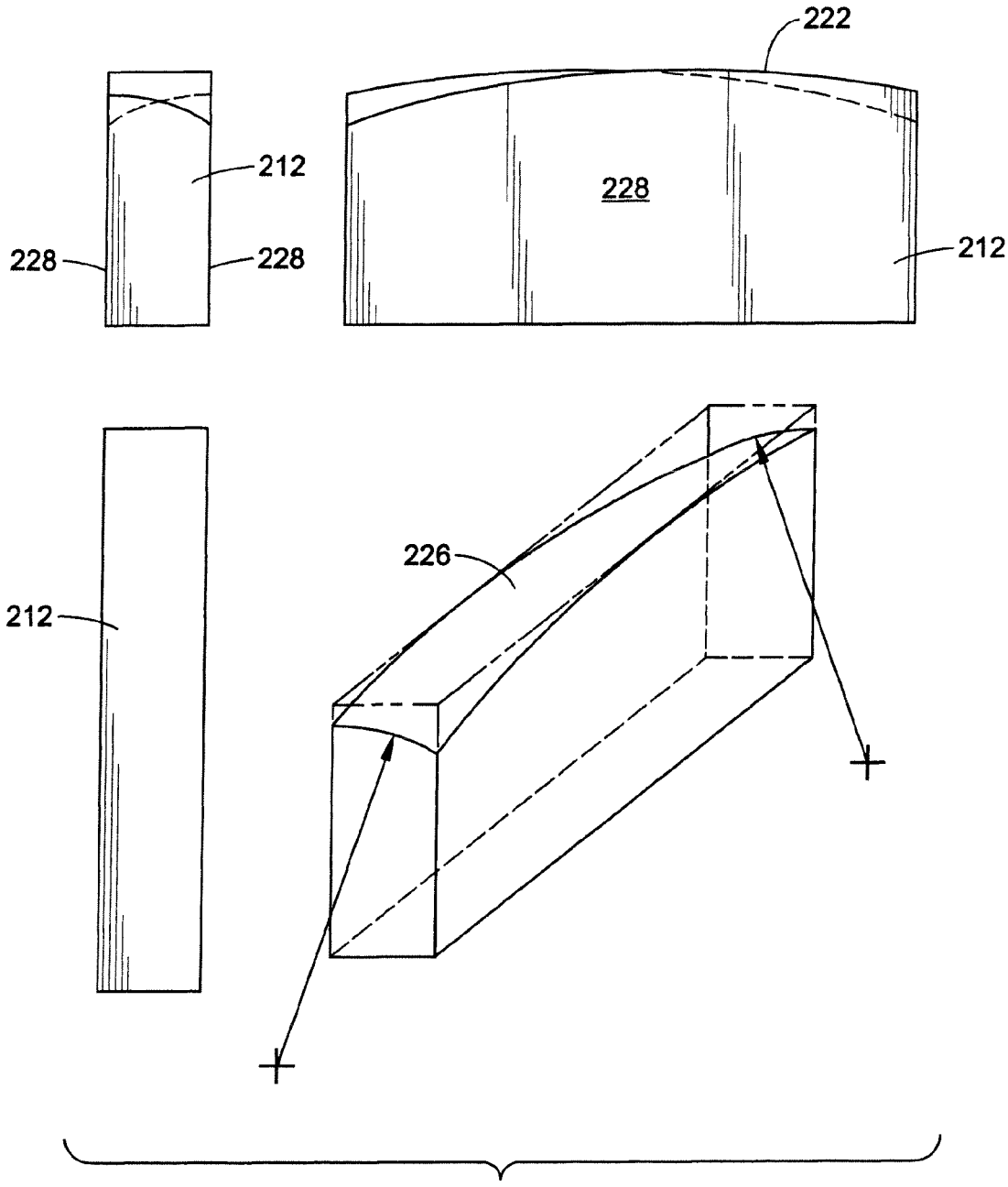
Figure 10:
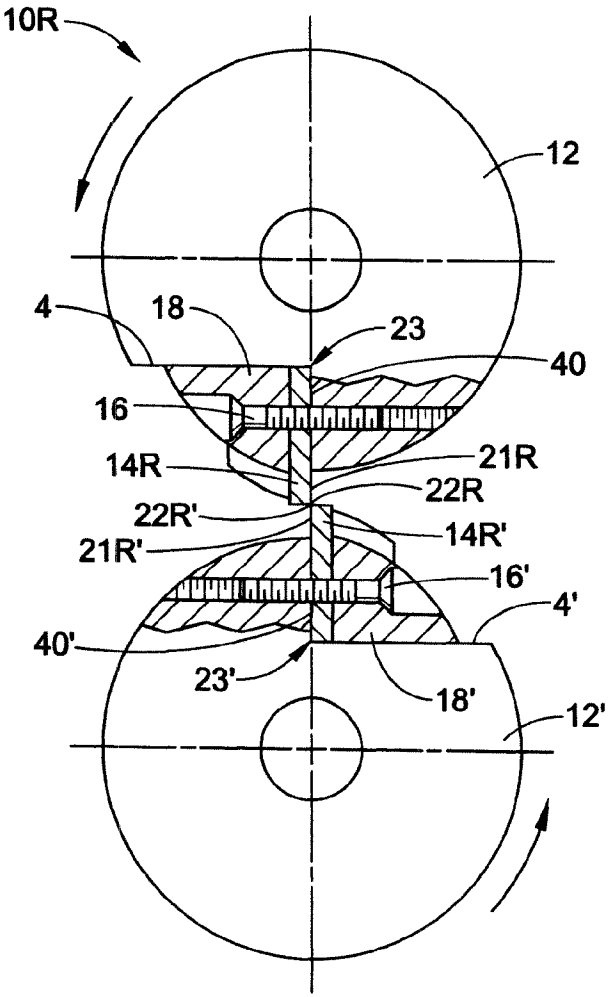
FIG. 10 is a cross-sectional view of the dual arbors of the present invention utilizing a two-dimensional knife blade after sharpening.

Referring to FIG. 6, a cross-sectional view of a single arbor of a second prior art dual arbor chopper is shown with each arbor 212 utilizing a three-dimensional helical knife blade 214 attached to the arbor 212. A fastener 216 is used to attach a mounting block 230 to the arbor 212 in a manner securing the knife blade 214 to the arbor 212. The knife blade 214 has a cutting face side 220 having a cutting edge 222 which cooperates with the cutting edge of an opposing arbor (not shown). After use, the cutting edge 222 becomes dull and needs to be resharpened. The helical knife blade 214 is sharpened by mounting the knife blade 214 in a drum fixture 234 and removing a portion of a top side 226 of the helical knife blade 214 with a grinding wheel 250 as shown in FIG. 7A creating cutting edge 222R. In FIG. 7B, various views of a typical helical knife 214 are shown. It is noted that the top side 226 is a three dimensional surface that is not perpendicular to its side faces 228. Referring now to FIG. 8, the sharpened knife blade 214R is remounted on arbor 212 with a shim 240 used to replace the removed material such that the cutting edge 222R is re-positioned in the same location as when the knife blade 214R was in the new condition. In this case, the shim 240 radially elevates the knife blade.

Figure 9:
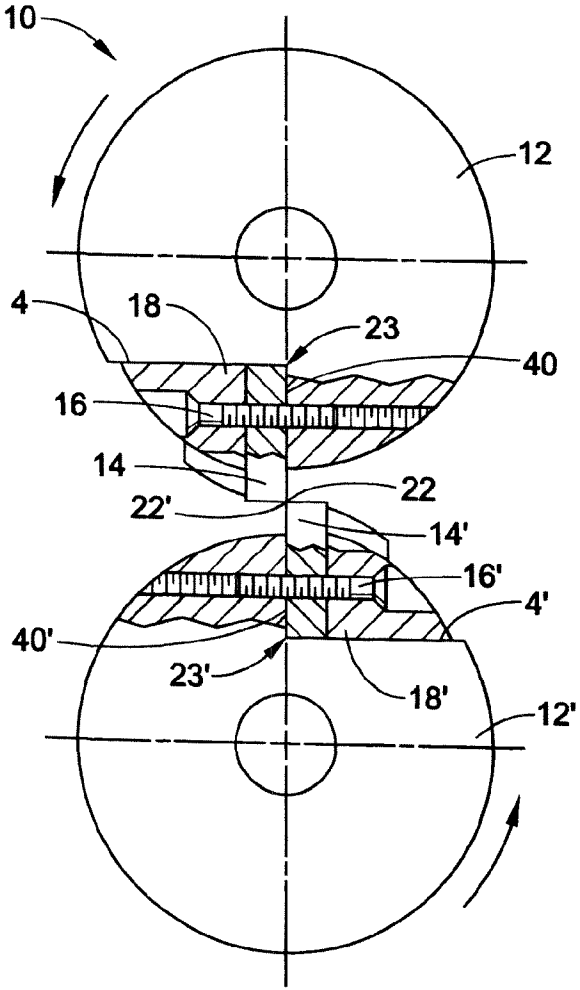
FIG. 9 is a cross-sectional view of the dual arbors of the present invention utilizing a two-dimensional knife blade.
Figure 13:
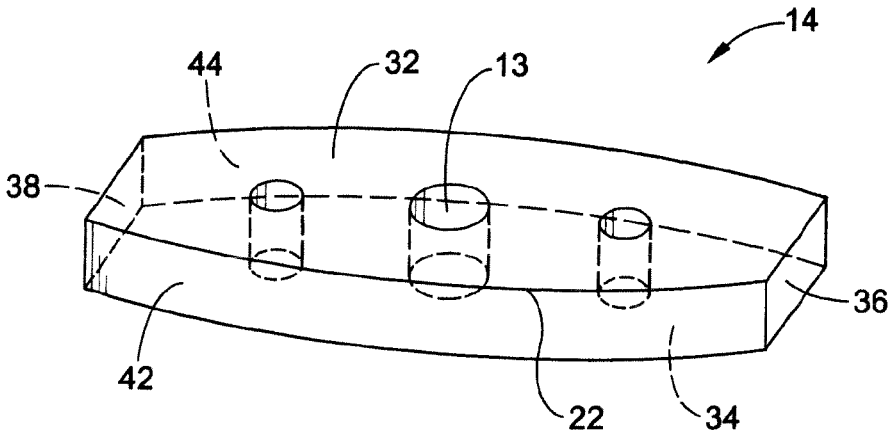
FIG. 13 is a perspective view of a two-dimensional knife blade used in an embodiment of the present invention as shown in FIG. 9.

The present invention will now be described in detail with reference to FIG. 9 which shows a cross-sectional view of a dual arbor chopper 10 with each arbor 12, 12' utilizing a two-dimensional knife blade 14, 14' attached to the arbor 12, 12'. As best shown in FIG. 13, each blade 14, 14' comprises a first face side 32, generally parallel to a second face side 34, a first end 36 opposite a second end 38, and a top surface 42 opposite a bottom surface 44, wherein an active cutting edge 22 is formed at the intersection of the top surface 42 and the first face side 32, wherein the active cutting edge 22 is formed at least in part as a radius or an ellipse in the axial direction of the arbor 12. Referring again to FIG. 9, each arbor 12, 12' comprises at least one blade attachment recess 23, 23' formed by a first planar register surface 40, 40' and a second register surface 4, 4' generally perpendicular to the first planar register surface 40. Second register surface 4 may be concave transversely to correspond to the curved bottom surface 44 of the blade 14 as shown in the prior art arbor 112 of FIG. 2. Each blade 14, 14' is positioned in a corresponding blade attachment recess 23, 23' such that the first face side 32, 32' registers against the first planar register surface 40, 40' of the arbor 12, 12' and the bottom surface 44, 44' of the blade 14, 14' registers against the second register surface 4, 4' of the arbor 112, 112'. A fastener 16, 16' is positioned through a clamping block 18, 18' and an aperture 13, 13' in the knife blade 14, 14' to attach the knife blade 14, 14' to the arbor 12, 12'. The clamping block 18, 18' is utilized to provide a backing for the knife blade 14, 14' against the cutting force during operation of the chopper 10.

The orientation of the blade recess 23, 23' of arbor 12, 12' of the present invention is opposite that of a conventional two-dimensional knife bladed arbor 112 as shown in FIG. 3. In the present invention, the first face side 32, or cutting face side of the knife blade 14 registers against the upstanding surface 40 of the arbor 12. In the prior art arbor 112, the cutting face side 120 was opposite the upstanding surface 140 of the arbor 112.

After use, the cutting edge 22 of the blade 14 of the present invention becomes dull and needs to be resharpened. The knife blade 14 is sharpened by removing a portion of the face side as previously shown in FIG. 4A and 4B to create knife blade 14R having cutting edge 22R. Referring now to FIG. 8, the knife blade 14R is remounted on arbor 12 such that the newly formed cutting face side 32R registers against the surface 40 of the arbor 12. Newly formed cutting edge 22R remains in the same location as when the knife blade 14 was in the new condition. The fastener 16 is tightened to move the clamping block 40 laterally to compensate for the change in material thickness of the knife blade 14. No shims are required with the arbor/knife blade of the present invention, saving the set-up time required when using shims.

The knife blades of the present invention may have four cutting edges as the knife blades disclosed in co-owned U.S. Pat. No. 4,858,506. The knife blades are not intended to be limited to four cutting edge configurations as the present invention will also work with similar two dimensional knife blades having one or more cutting edges.

For knife blades used in the present invention having multiple cutting edges, the term active cutting edge means the cutting edge that is actually positioned to make the cut and the remaining cutting edges are considered inactive cutting edges. It is also noted that dual arbor choppers of the present invention and in the prior art may utilize what is referred to as a master shim on the register surface of the arbor. The master shim is produced by the dual arbor chopper manufacturer to properly position cutting edge of the knives when the knife blades are attached to the arbor. The master shim is used due to the difficulty of final machining the register surface of the arbor to ensure proper positioning of a blade. Once the master shim is attached to the register surface during manufacturing, it does not need to be replaced or modified. The master shim is not shown in the present invention. For purposes of this invention, the master shim (not shown) is considered to be part of the register surface 40 of the arbor 12. For purposes of this invention a shim is a thickness of material used to compensate for the loss of material of a knife blade in the sharpening process. The end result of the use of a shim is that the sharpened active cutting edge of the knife is repositioned where it was when it was in a new condition.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A method of performing maintenance for a plurality of blades of a dual arbor chopper comprising the steps of:

providing a dual arbor chopper comprising a support housing, a pair of oppositely disposed arbors rotatably positioned within the housing, each arbor having at least one blade attached to the arbor by a clamping block in a first position and at least one fastener positioned through an aperture in the clamping block and an aperture in the blade, each blade comprising a first face side generally parallel to a second face side, and a top surface opposite a bottom surface, wherein a first active cutting edge is formed at the intersection of the top surface and the first face side and is positioned in a first cutting edge position, wherein the first face side of the blade registers against the arbor and the clamping block registers against the second face side of the blade;

removing the fastener and the clamping block from each arbor to release the blade when said first active cutting edge of the blade is worn;

sharpening each blade by grinding at least the first face side of the blade to form a second active cutting edge;

attaching the blade to the arbor with the fastener and the clamping block such that the clamping block is positioned in a second position displaced from the first position by an amount equal to the material ground from the blade; and said second active cutting edge is positioned in a second cutting edge position which is the same as said first cutting edge position without the use of a shim.

2. The method of claim 1, wherein the step of sharpening the blade is accomplished by grinding the first face side and the second face side opposite the first face side of the blade.

3. The method of claim 1, wherein the step of attaching the blade to the arbor includes the step of orienting the blade such that the first face side of the blade registers against the arbor and the clamping block registers against the second face side of the blade.

4. The method of claim 1, wherein the step of sharpening the blades is accomplished by:

positioning the plurality of blades on a table; and moving the table such that at least a first face side of each of the blades come into contact with a grinder that removes a predetermined depth of the first face side of the plurality of blades.

5. The method of claim 1, wherein the step of attaching the blade to the arbor does not include the step of using a shim positioned adjacent the blade such that the shim compensates for the material removed from the blade during the step of sharpening the blade.

6. The method of claim 1, wherein the step of attaching the blade to the arbor includes positioning the clamping block on a side of the blade opposite the second active cutting edge of the blade.

7. The method of claim 1, wherein the second active cutting edge of the blade is formed at least in part as a radius or an ellipse.

* * * * *